US009981476B2

(12) United States Patent
Muraoka et al.

(10) Patent No.: US 9,981,476 B2
(45) Date of Patent: May 29, 2018

(54) LIQUID DISCHARGE HEAD

(71) Applicant: CANON KABUSHIKI KAISHA, Tokyo (JP)

(72) Inventors: Chiaki Muraoka, Kawaguchi (JP); Yukuo Yamaguchi, Tokyo (JP); Mikiya Umeyama, Tokyo (JP); Hiromasa Amma, Kawasaki (JP); Takuya Iwano, Inagi (JP); Tokuji Kudo, Koriyama (JP); Shimpei Yoshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 15/334,061

(22) Filed: Oct. 25, 2016

(65) Prior Publication Data

US 2017/0120588 A1 May 4, 2017

(30) Foreign Application Priority Data

Oct. 28, 2015 (JP) ..... 2015-212018

(51) Int. Cl.

| | |
|---|---|
| ***B41J 2/175*** | (2006.01) |
| ***B41J 29/13*** | (2006.01) |
| ***B41J 2/14*** | (2006.01) |
| ***B41J 29/02*** | (2006.01) |

(52) U.S. Cl.

CPC ..... *B41J 2/1753* (2013.01); *B41J 2/1433* (2013.01); *B41J 2/1752* (2013.01); *B41J 2/17509* (2013.01); *B41J 2/17526* (2013.01); *B41J 2/17553* (2013.01); *B41J 29/02* (2013.01); *B41J 29/13* (2013.01); *B41J 2002/14491* (2013.01)

(58) Field of Classification Search

CPC ..... B41J 2/14; B41J 2002/14362; B41J 2002/14491; B41J 2202/03; B41J 2202/11; B41J 2202/13

See application file for complete search history.

(56) References Cited

U.S. PATENT DOCUMENTS

2003/0160841 A1* 8/2003 Takata ..... B41J 2/14209 347/50
2013/0182046 A1* 7/2013 Kodama ..... B41J 2/1752 347/85
2013/0231430 A1* 9/2013 I ..... C08L 53/025 524/323

FOREIGN PATENT DOCUMENTS

JP 2007-268867 A 10/2007
JP 2012-192749 A 10/2012

* cited by examiner

*Primary Examiner* — Kristal Feggins
*Assistant Examiner* — Kendrick Liu
(74) *Attorney, Agent, or Firm* — Canon U.S.A., Inc. IP Division

(57) ABSTRACT

A liquid discharge head includes a recording element substrate including a recording element, an electronic substrate disposed outside the recording element substrate, an electric element mounted on the electronic substrate, a housing that supports the recording element substrate and the electronic substrate and is made of a first resin material, and a cover member that surrounds and shields the electric element and is made of a second resin material, wherein the second resin material has higher heat resistance than the first resin material.

18 Claims, 6 Drawing Sheets

LIQUID DISCHARGE HEAD

BACKGROUND

Field of the Disclosure

The present disclosure relates to a liquid discharge head including a recording element substrate and an electric element mounted outside the recording element substrate.

Description of the Related Art

A typical liquid discharge head included in a recording apparatus is configured such that an electric element, such as a capacitor for stabilizing driving of a recording element, is mounted on a member different from a recording element substrate. Japanese Patent Laid-Open No. 2007-268867 discloses an example of such a liquid discharge head. Japanese Patent Laid-Open No. 2007-268867 describes a configuration in which electric components are accommodated in a housing of the head in order to prevent the electric components from being damaged by application of external force. Furthermore, this configuration enables a further reduction in size of the head. However, this configuration, in which the housing accommodates the electric components, has the following disadvantage: insufficient heat resistance of a resin material for the housing may cause the resin material to melt upon excessive heat generation of the electric components.

Excessive heat generation of electric components more often tends to occur due to an increase in power consumption of the electric components resulting from an increase in number of recording elements and an increase in recording density per unit time promoted by recent improvement in recording speed of liquid discharge heads.

The excessive heat generation of electric components may be abnormal heat generation, in which generated heat exceeds an upper limit temperature estimated based on a specification, caused by spontaneous failure or random failure. A resin material for a housing is required to be resistant to abnormal heat generation.

Unfortunately, highly heat-resistant resin materials for such a head housing tend to exhibit low flowability in molding. These materials may be unsuitable for highly advanced molding.

Specifically, low flowability of a material to be molded inhibits molding of a structure with thin walls arranged at high density in a small space. Unfortunately, this restricts the miniaturization of a head housing.

Examples of advanced molding methods include a method of primarily molding a plurality of members in a single die, fitting the primarily molded members to each other in the die, and sealing the interface of the fitted members by secondary molding to join the members. This method is described in, for example, Japanese Patent Laid Open No. 2012-192749.

For such advanced molding, a material having high flowability, or poor heat resistance has to be selected and used in most cases. A disadvantage of such a case is incompatibility between good formability of a head and good heat resistance of a material.

SUMMARY

The present disclosure provides a liquid discharge head that includes a recording element substrate on which a recording element is mounted and an electronic component (electric element) mounted outside the recording element substrate and that is configured to achieve good formability of a housing of the head and good heat resistance to excessive heat generation of the electric element.

An aspect of the present disclosure provides a liquid discharge head that includes a recording element substrate including a recording element, an electronic substrate disposed outside the recording element substrate, an electric element mounted on the electronic substrate, a housing that supports the recording element substrate and the electronic substrate and is made of a first resin material, and a cover member that surrounds and shields the electric element and is made of a second resin material. The second resin material has higher heat resistance than the first resin material.

Further features of the present disclosure will become apparent from the following description of exemplary embodiments with reference to the attached drawings.

DESCRIPTION OF THE EMBODIMENTS

Figure 1:
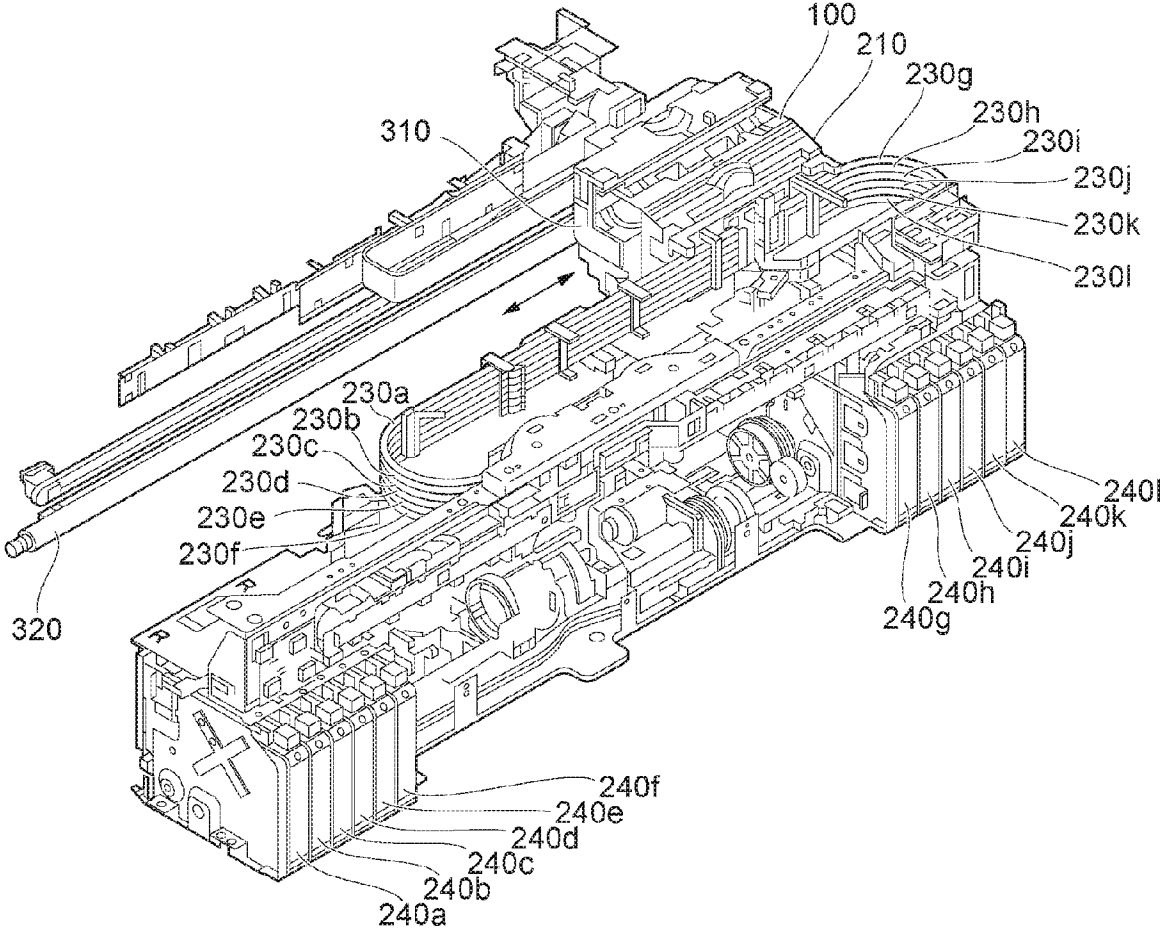
FIG. 1 is a perspective view of part or an inkjet recording apparatus according to one or more aspects of the current disclosure.

Embodiments of the present disclosure will be described below with reference to the drawings. The present disclosure is not limited to these embodiments. FIG. 1 is a perspective view of an inkjet recording apparatus to which a liquid discharge head according to one or more aspects of the present disclosure.

A liquid discharge head 100 is mounted in a carriage 310. The carriage 310 moves along a shaft 320 in a direction (indicated by arrows in FIG. 1) perpendicular to a sheet conveying direction. An image is formed on a recording medium supplied to an area (in lower part of FIG. 1) under discharge ports of the liquid discharge head 100.

Figure 2:
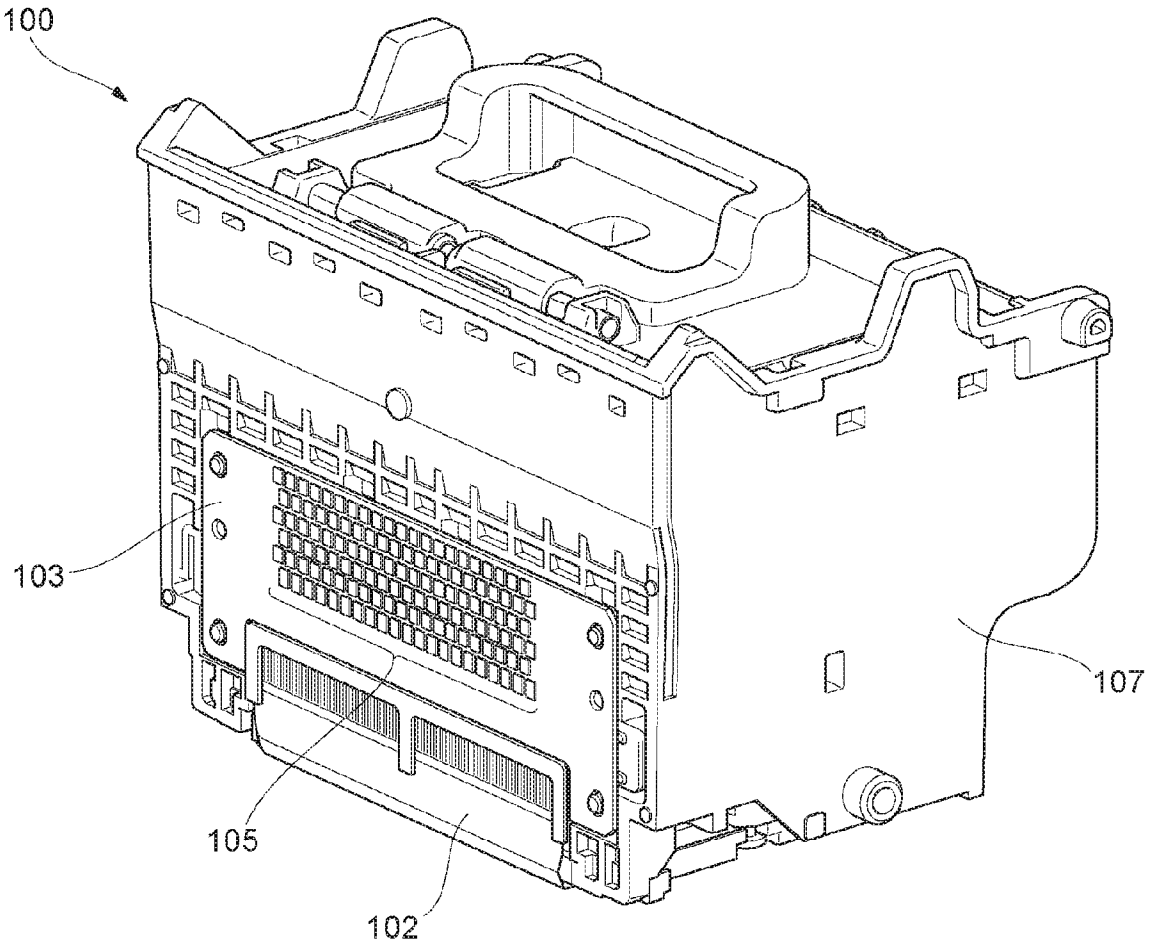
FIG. 2 is a perspective view illustrating an exemplary configuration of a liquid discharge head according to one or more aspects of the present disclosure.
Figure 3:
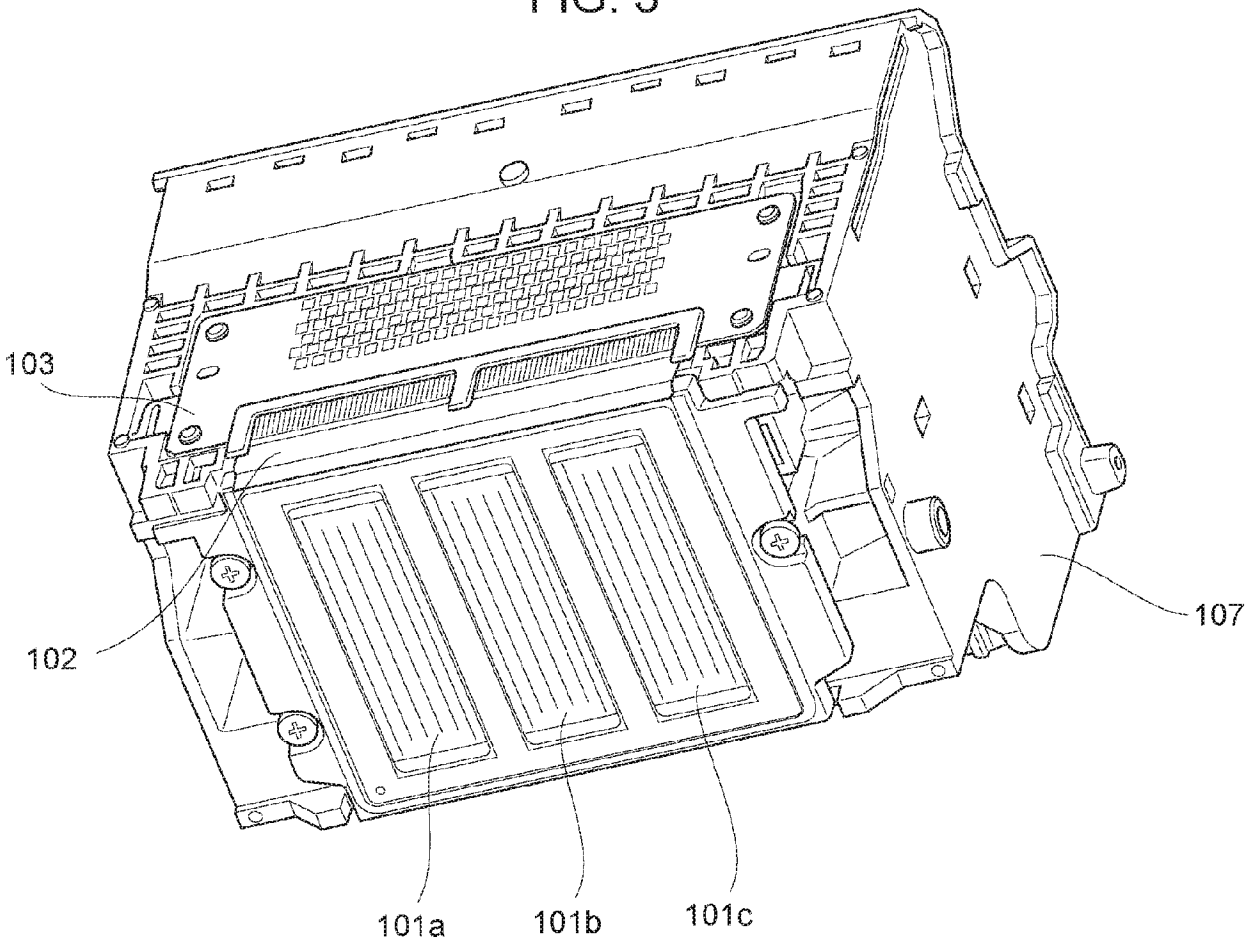
FIG. 3 is a perspective view illustrating the configuration of the liquid discharge head according to one or more aspects of the present disclosure.

FIGS. 2 and 3 are perspective views of the liquid discharge head 100 according to one or more aspects of the present disclosure.

The liquid discharge head 100 is detachably attachable to a main body of the recording apparatus. When the liquid discharge head 100 is attached to the main body of the apparatus, contact pads 105 on a wiring substrate 103 are electrically connected to contact probes (not illustrated) of the main body of the recording apparatus.

Electrical signals received through the contact pads 105 from the main body of the recording apparatus are transferred to recording element substrates 101*a*, 101*b*, and 101*c* via the wiring substrate 103 and a wiring member 102. Recording elements on the recording element substrates are driven in response to the signals, thus performing a recording operation (i.e., discharging recording ink). The recording element substrates 101*a*, 101*b*, and 101*c* are provided with individual electric wiring lines (not illustrated).

The wiring substrate 103 is positioned and secured to a housing 107 such that the contact pads 105 are secured at predetermined positions.

Each of the recording element substrates can discharge recording inks of four colors. The liquid discharge head achieves recording with inks of up to 12 colors. FIG. 1 illustrates an exemplary configuration with 12 ink tanks 240*a* to 240*l* and ink supply tubes 230*a* to 230*l* for supplying ink from a corresponding one of the ink tanks to the liquid discharge head. A joint member 210 functions as a liquid supply member.

Figure 4:
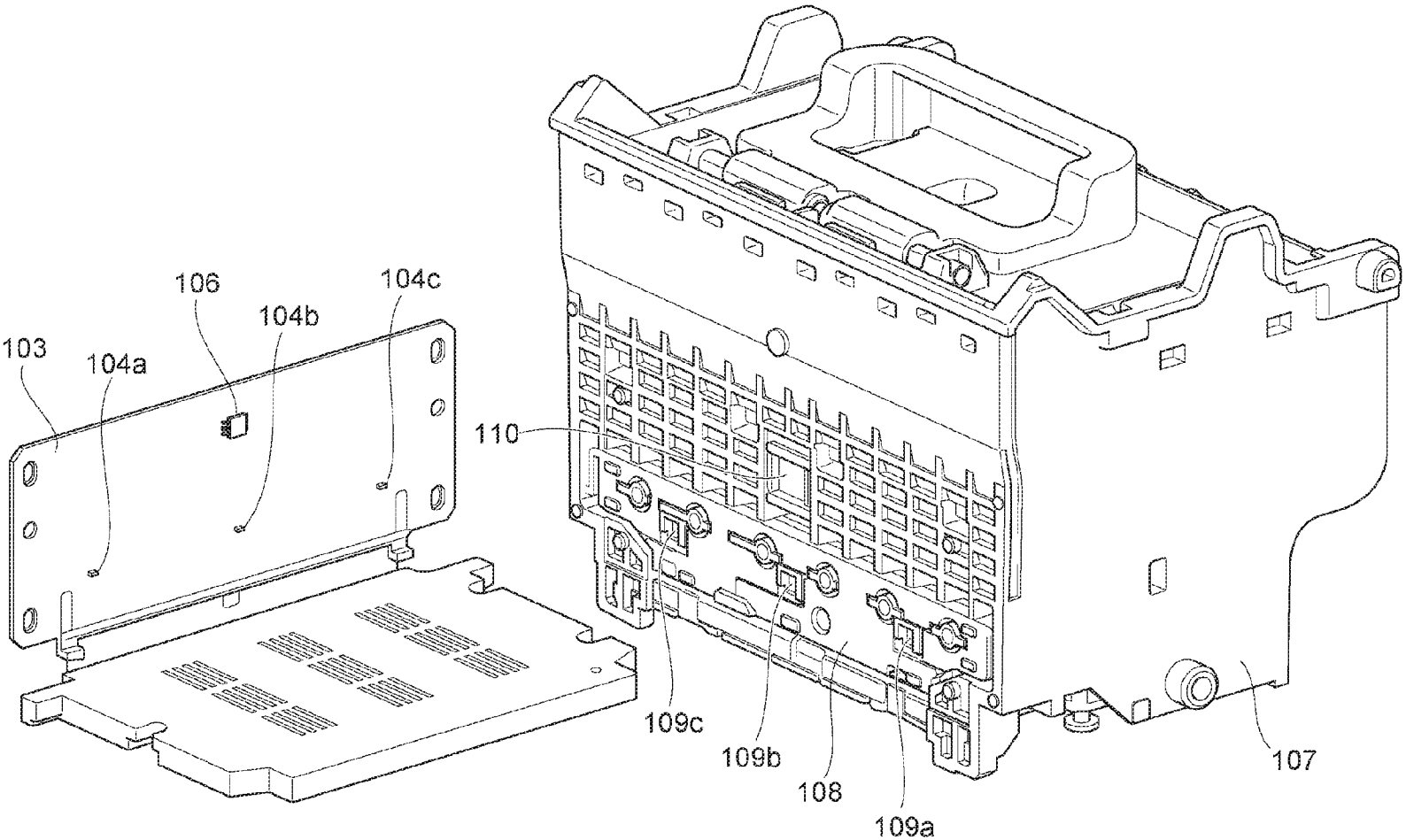
FIG. 4 is an exploded perspective view illustrating an internal structure of the liquid discharge head according to one or more aspects of the present disclosure.

FIG. 4 is an exploded perspective view illustrating an internal structure of the liquid discharge head 100 according to one or more aspects of the present disclosure.

The wiring substrate 103 has a back surface on which capacitors 104*a*, 104*b*, and 104*c* for stabilizing a power supply voltage for the recording element substrates 101*a*, 101*b*, and 101*c* are mounted. The wiring substrate 103 serves as an electronic substrate including an electronic element, such as a capacitor. The electronic substrate in the present disclosure is not limited to the wiring substrate 103 but may be any substrate that is disposed outside a recording element substrate and that includes an electronic element.

A capacitor cover 108 is attached as a separate member to the housing 107 such that the capacitor cover 108 is positioned so as to face the capacitors 104*a*, 104*b*, and 104*c*. The capacitor cover 108, serving as a separate member, corresponds to a cover member in the present disclosure. The cover member is disposed between the electronic substrate and the housing to achieve miniaturization of the liquid discharge head 100.

The capacitor cover 108 includes capacitor pockets 109*a*, 109*b*, and 109*c* for receiving the capacitors 104*a*, 104*b*, and 104*c* while the wiring substrate 103 is secured to the housing 107.

The housing 107 is made of a resin material different from a resin material of which the capacitor cover 8 is made. The material of the capacitor cover 108 has higher heat resistance than that of the housing 107. Such a configuration is effective in preventing a problem, such as a reduction in mechanical performance of the housing, from occurring upon excessive heat generation of the capacitors during the operation of the liquid discharge head or upon abnormal heat generation caused by random failure or the like. Such generated heat may reach 200° C. or higher.

In some embodiments, the material of the capacitor cover 108 has a higher glass transition temperature (Tg) than that of the housing 107. For example, the Tg of the material (hereinafter, also referred to as a second resin material) of the capacitor cover 108 is higher than that of the material (hereinafter, also referred to as a first resin material) of the housing 107 by preferably 10° C. or more, more preferably 50° C. or more.

In some embodiments, the material of the capacitor cover 108 has a higher melting point (MP) than that of the housing 107. For example, the MP of the material (second resin material) of the capacitor cover 108 is higher than that of the material (first resin material) of the housing 107 by preferably 10° C. or more, more preferably 50° C. or more.

The glass transition temperatures and the melting points of the resin materials can be measured by known methods, such as differential scanning calorimetry (DSC).

In some embodiments, the material of the capacitor cover 108 has a lower melt flow rate (MFR) than that of the housing 107. In other words, the first resin material has higher flowability than the second resin material. For example, the MFR of the material (second resin material) of the capacitor cover 108 is lower than that of the material (first resin material) of the housing 107 by 20% or more. More preferably, the MFR of the second resin material is less than or equal to half the MFR of the first resin material. Specifically, the first resin material can have an MFR of 27 g/10 min and the second resin material can have an MFR of 6 g/10 min at 250° C. under a pressure of 10 kg.

As described above, the use of the second resin material having higher heat resistance than the first resin material can eliminate or reduce a likelihood that the second resin material may flow upon abnormal heat generation.

In some embodiments, the material of the capacitor cover 108 is softer than that of the housing 107. In this case, the elastic coefficient of a resin material can be used as a criterion of softness. For example, the elastic coefficient of the material (second resin material) of the capacitor cover 108 may be lower than that of the material (first resin material) of the housing 107 by 20% or more.

Each of the first resin material for the housing and the second resin material for the cover member may be any material that meets the above-described requirements. For example, the first and second resin materials can be prepared by using the same base resin and adjusting compositions for the first and second resin materials. Examples of the base resin include modified polyphenylene ether. Modified polyphenylene ethers having different heat resistances can be produced by changing the method of polymerization or the degree of polymerization. In addition, different base resins can be used. For example, polyethylene terephthalate can be used as another base resin.

Figure 6:
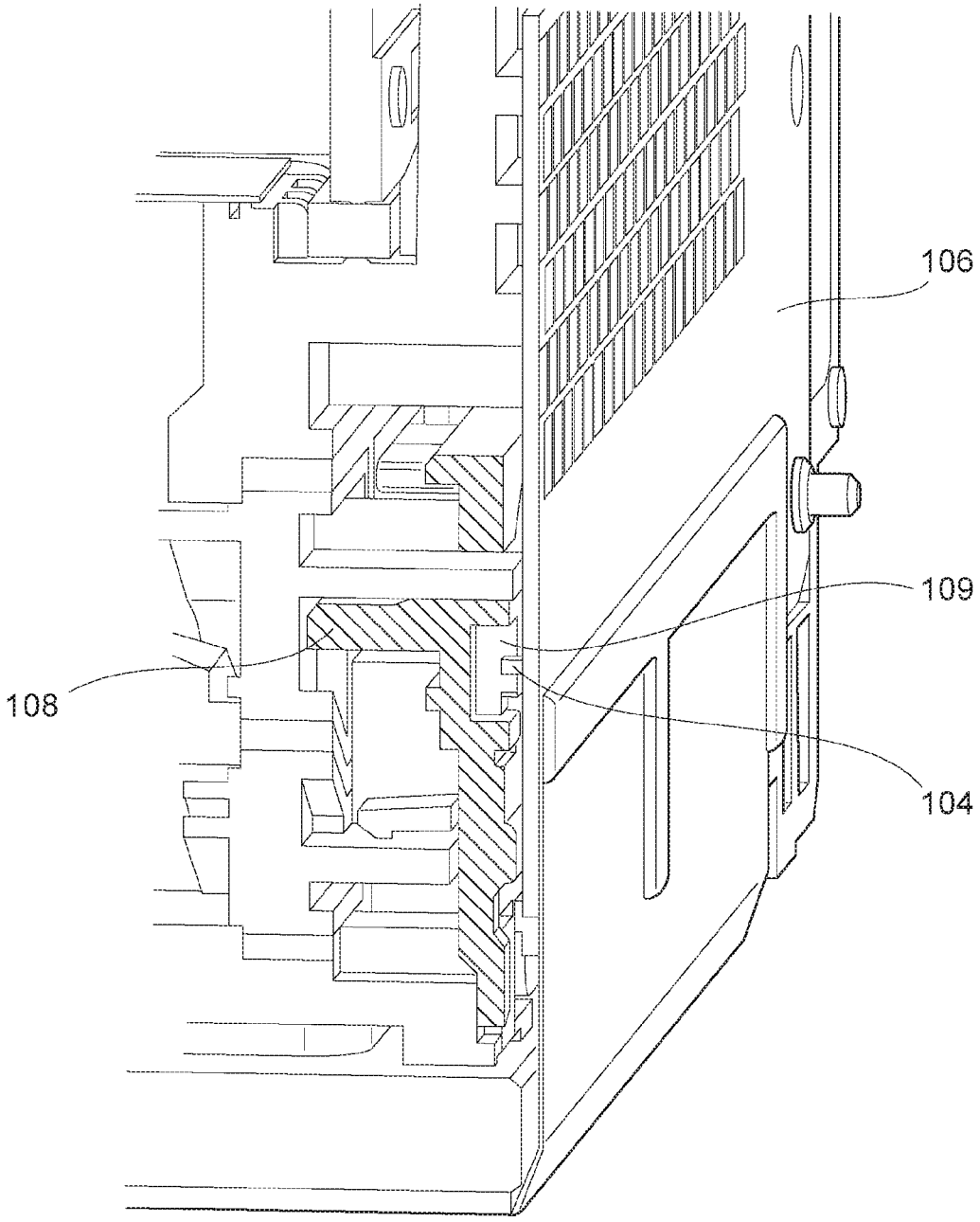
FIG. 6 is a perspective sectional view illustrating the internal structure of the liquid discharge head according to one or more aspects of the present disclosure.

The capacitor pockets 109*a*, 109*b*, and 109*c* of the capacitor cover 108 are in substantially contact with the back surface of the wiring substrate 103, thus substantially shielding the capacitors 104*a*, 104*b*, and 104*c*. As illustrated in FIG. 6, each capacitor 104 can be surrounded and shielded by the capacitor pocket 109 of the capacitor cover 108 such that the capacitor is not in contact with the capacitor cover.

Such a configuration prevents deposit of liquid components, such as ink mist, in a capacitor mounting area and contributes to restriction of a range affected by excessive heat generation of the capacitor.

In some embodiments, the capacitor cover 108 for protecting the wiring substrate 103 against damage is made of a filler-free material because the back surface of the wiring substrate 103 may come into contact with the capacitor cover 108.

On the other hand, the housing 107 may have high rigidity to eliminate or reduce deformation of the entire liquid discharge head 100. For example, the housing 107 can be made of a filler-containing material.

Although the material of the capacitor cover 108 may contain filler, the filler content in the capacitor cover 108 may be less than that in the housing 107.

Examples of the filler include glass, mica, and silica. Such a substance can be used in form of, for example, particles (beads) or fibers.

In the above-described configuration of the liquid discharge head 100, the capacitors 104*a*, 104*b*, and 104*c* and the capacitor cover 108 are arranged on the back surface of the wiring substrate 103. The present disclosure is not limited to this configuration.

The capacitors 104*a*, 104*b*, and 104*c* and the capacitor cover 108 may be arranged on a front surface of the wiring substrate 103.

Figure 5:
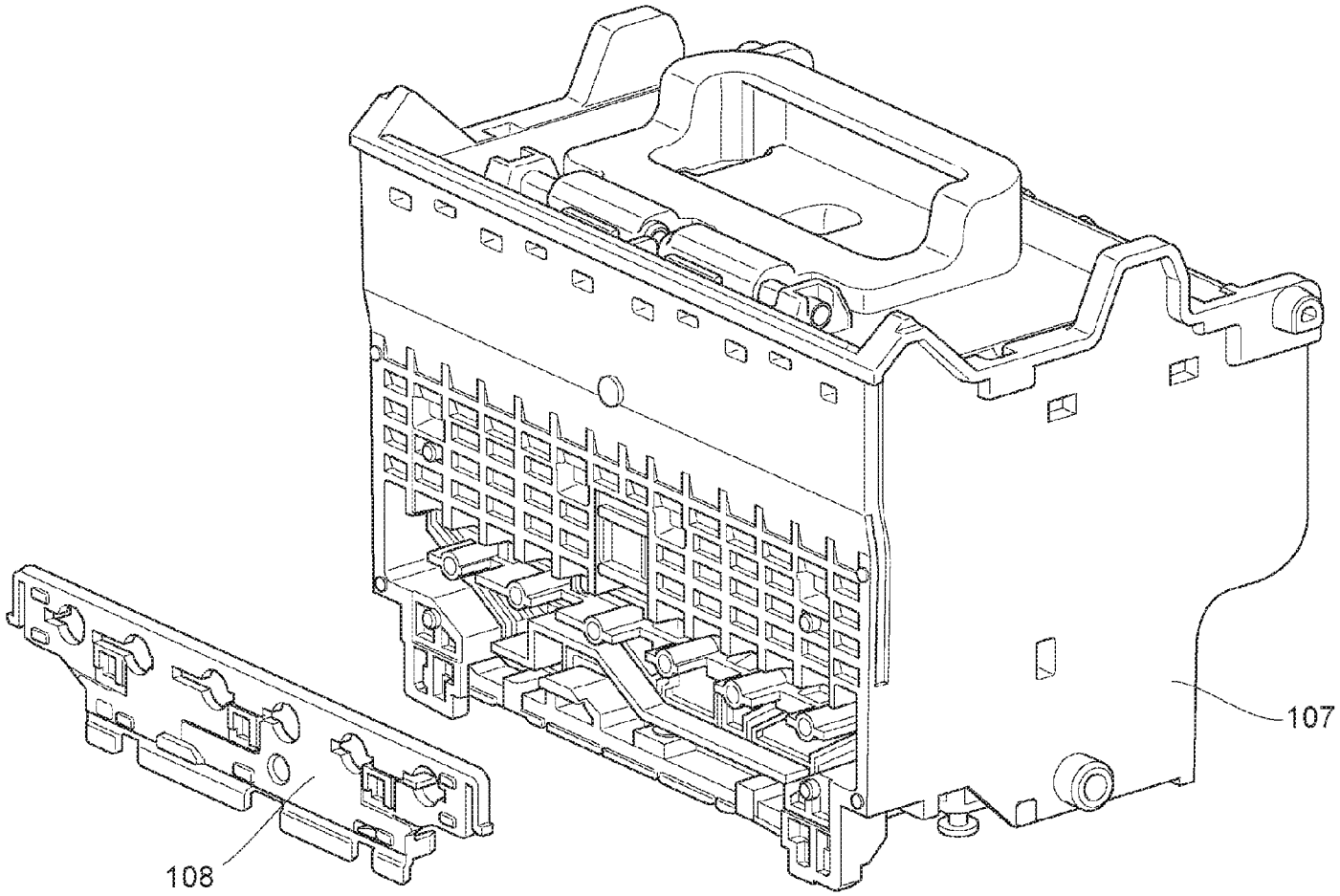
FIG. 5 is an exploded perspective view illustrating an internal structure of the liquid discharge head according to one or more aspects of the present disclosure.

FIG. 5 is an exploded perspective view illustrating the configuration of the housing 107 and that of the capacitor cover 108 in the liquid discharge head according to one or more aspects of the present disclosure.

The housing 107 has a complicated structure in which 12 flow passages for supplying ink to the recording element substrates are arranged at high density. In contrast, the capacitor cover 108 has a shape relatively easy to mold.

Each of the housing 107 and the capacitor cover 108 can be produced by a molding method suitable for a material used. The housing 107, which has a complicated structure, is formed as an assembly of parts. For example, the following advanced molding method can be used: The parts are simultaneously molded in a single die (primary molding), the parts are assembled in the die, and the same resin material as that used in the primary molding is supplied to junctions of the parts (secondary molding), thus completing the assembly in the die. The capacitor cover 108 can be molded with a die different from that for the housing. The configuration according to the present disclosure is effective, particularly, when the above-described advanced molding method is used to mold the housing 107.

As described above, the material of the housing 107 produced by the advanced molding method exhibits higher formability than the material of the capacitor cover 108.

The capacitor cover 108 can be positioned at a predetermined position and be attached to the housing 107 in a spring-urged manner. The capacitor cover 108 can include spring portions in both outer ends in the longitudinal direction of the capacitor cover 108 such that the spring portions are tapered toward the housing and have a notch. The capacitor cover 108 can be pressed into an engagement portion of the housing 107, thus achieving spring-urged attachment. Furthermore, the capacitor cover 108 can include abutment portions for limiting contact with the wiring substrate such that the abutment portions are arranged on a surface of the capacitor cover 108 facing the wiring substrate. The abutment portions can be arranged so as not to interfere with steps on the wiring substrate. Flat writing lines may be arranged on the wiring substrate such that the flat wiring lines are in contact with the abutment portions.

Although the configuration in which the capacitors are mounted on the wiring substrate 103 is illustrated, the present disclosure can be applied to a configuration in which electric elements other than capacitors are mounted on the wiring substrate 103. In other words, the present disclosure can be applied to general electric elements that have a risk of excessive heat generation, for example, light-emitting elements, resistors, diodes, and transistors. The larger the capacity of a power supply for such an electric element, the higher the risk of excessive heat generation. The present disclosure can be applied to all of components connected to a power supply having a capacity of more than two watts.

In some embodiments, the liquid discharge head 100 includes a memory device 106 on the back surface of the wiring substrate 103 in addition to the capacitors 104*a*, 104*b*, and 104*c* as illustrated in FIG. 4.

This memory device has a function of storing information necessary for optimum driving of the liquid discharge head 100 and traceability information indicating, for example, date of manufacture. The recording apparatus reads data from and writes data to the memory device.

In this embodiment, a maximum current to be supplied to the memory device 106 is limited in the main body of the recording apparatus such that the risk of excessive heat generation is reduced.

In such a configuration, the memory device 106 faces not the capacitor cover 108 but the housing 107 while the wiring substrate 103 is secured to the housing 107.

The memory device 106 is received in a memory pocket 110 made of the material of the housing 107.

As described above, according to the present disclosure, the liquid discharge head including the electric elements includes the housing that supports the recording element substrates and the electronic substrate, and further includes the cover member made of a resin material different from a resin material of the housing. The material of the housing has good formability and the material of the cover member surrounding and shielding the electric elements has good heat resistance.

This configuration prevents the housing from being affected by excessive heat generation of the electric elements, thus avoiding at least excessive damage to the liquid discharge head 100. Since this configuration is achieved without sacrificing the formability of the housing of the head, for example, a reduction in size of the liquid discharge head can be achieved without limitation. Thus, compatibility between good formability of the housing of the liquid discharge head and good heat resistance can be achieved.

According to the present disclosure, the material of the housing may contain filler to provide rigidity necessary for the housing. On the other hand, the material of the cover member may contain a smaller amount of filler than the material of the housing or may be free from filler. Such a configuration can reduce a risk that, if the cover member disposed in the vicinity of electric elements mounted on a substrate interferes with and contacts the substrate, the cover member may damage the substrate. Specifically, the second resin material of the cover member contains a smaller amount of filler than the first resin material of the housing.

As described above, according to the present disclosure, the liquid discharge head, in which the electronic components (electric elements) are mounted outside the recording element substrate on which the recording elements are arranged, can be configured to achieve good heat resistance to heat generated from the electric elements and good formability of the housing of the head.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-212018, filed Oct. 28, 2015, which is hereby incorporated by reference herein in its entirety.

What is claimed is:

1. A liquid discharge head comprising:

a recording element substrate including a recording element;

an electronic substrate disposed outside the recording element substrate;

an electric element mounted on the electronic substrate;

a housing that supports the recording element substrate and the electronic substrate and comprises a first resin material; and a cover member that surrounds and shields the electric element and comprises a second resin material, the second resin material having higher heat resistance than the first resin material, and a smaller amount of filler than the first resin material.

2. The liquid discharge head according to claim 1, wherein the second resin material has a higher glass transition temperature than the first resin material.

3. The liquid discharge head according to claim 1, wherein the second resin material has a higher melting point than the first resin material.

4. The liquid discharge head according to claim 1, wherein the second resin material has a lower melt flow rate than the first resin material.

5. The liquid discharge head according to claim 1, wherein the second resin material is softer than the first resin material.

6. The liquid discharge head according to claim 1, wherein the cover member is disposed between the housing and the electronic substrate.

7. A recording apparatus comprising:

a liquid discharge head configured to discharge liquid, the liquid discharge head including a recording element substrate including a recording element, an electronic substrate disposed outside the recording element substrate, an electric element mounted on the electronic substrate, a housing that supports the recording element substrate and the electronic substrate and comprises a first resin material, and a cover member, disposed between the housing and the electronic substrate, that surrounds and shields the electric element and comprises a second resin material; and a carriage holding the liquid discharge head, wherein the second resin material of the cover member has higher heat resistance than the first resin material of the housing.

8. The liquid discharge head according to claim 7, wherein the second resin material has a higher glass transition temperature than the first resin material.

9. The liquid discharge head according to claim 7, wherein the second resin material has a higher melting point than the first resin material.

10. The liquid discharge head according to claim 7, wherein the second resin material has a lower melt flow rate than the first resin material.

11. The liquid discharge head according to claim 7, wherein the second resin material is softer than the first resin material.

12. The liquid discharge head according to claim 7, wherein the second resin material contains a smaller amount of filler than the first resin material.

13. A liquid discharge head comprising:

a recording element substrate including a recording element;

an electronic substrate disposed outside the recording element substrate;

an electric element mounted on the electronic substrate;

a housing that supports the recording element substrate and the electronic substrate and comprises a first resin material; and a cover member, disposed between the housing and the electronic substrate, that surrounds and shields the electric element and comprises a second resin material, the second resin material having higher heat resistance than the first resin material.

14. The liquid discharge head according to claim 13, wherein the second resin material has a higher glass transition temperature than the first resin material.

15. The liquid discharge head according to claim 13, wherein the second resin material has a higher melting point than the first resin material.

16. The liquid discharge head according to claim 13, wherein the second resin material has a lower melt flow rate than the first resin material.

17. The liquid discharge head according to claim 13, wherein the second resin material is softer than the first resin material.

18. The liquid discharge head according to claim 13, wherein the second resin material contains a smaller amount of filler than the first resin material.

* * * * *